United States Patent [19]

Ushigome

[11] Patent Number: 4,691,440

[45] Date of Patent: Sep. 8, 1987

[54] FORKED SHELL AND MEMBRANE STRIPPER FOR BOILED EGGS

[76] Inventor: Hideji Ushigome, No. 19-15, 3-chome, Kugayama, Suginami-ku, Tokyo, Japan

[21] Appl. No.: 878,509

[22] Filed: Jun. 23, 1986

Related U.S. Application Data

[63] Continuation of Ser. No. 688,760, Jan. 4, 1985, abandoned.

[51] Int. Cl.[4] ..... A47J 43/28

[52] U.S. Cl. ..... 30/322; 30/137; D7/137; D7/147

[58] Field of Search ..... 30/322, 323, 129, 137, 30/147, 148, 150; 7/112; D7/137, 147

[56] References Cited

U.S. PATENT DOCUMENTS

| | | | |
|---|---|---|---|
| 1,313,417 | 8/1919 | Raymond | 7/112 X |
| 2,455,623 | 12/1948 | Stone | 30/322 X |
| 2,773,530 | 12/1956 | Sullivan | 30/322 X |
| 3,609,865 | 10/1971 | Golden | 30/322 |

FOREIGN PATENT DOCUMENTS

| | | | |
|---|---|---|---|
| 503151 | 5/1951 | Belgium | 30/322 |
| 2541 | of 1885 | United Kingdom | 30/322 |
| 348441 | 5/1931 | United Kingdom | 30/322 |

*Primary Examiner*—E. R. Kazenske
*Assistant Examiner*—Willmon Fridie, Jr.
*Attorney, Agent, or Firm*—Holman & Stern

[57] ABSTRACT

A handy, simple forked shell and membrane stripper capable of simultaneously stripping the shell and membrane of the boiled eggs consists of a step portion and a three-forked portion comprising one central fork and two side forks, the former having at its front end a head whose inner face may be preferably mountain-shaped or provided with a ridge, while the latter being bridged at their front ends to constitute a guide face sliding on the outer surface of the egg-shell so as to guide the central fork which is to creep under the membrane of the boiled egg.

2 Claims, 8 Drawing Figures

FORKED SHELL AND MEMBRANE STRIPPER FOR BOILED EGGS

This is a continuation of application Ser. No. 688,760, filed Jan. 4, 1985, now abandoned.

BACKGROUND OF THE INVENTION

This invention relates to a shell and membrane stripping means for boiled eggs mainly used in cooking. Stripping by hand the shell and membrane of boiled eggs usually requires careful and patient work, since the contents of egg, or the albumen and yolk, are wrapped in the membrane which sticks both to the shell and the soft, solidified albumen when boiled, and to make matters worse, rather persistently to the latter. This is largely inconvenient in case where a lot of eggs are to be stripped in a specified time and there is even such a danger that the contents of the eggs are damaged as a result of manual stripping.

SUMMARY OF THE INVENTION

This invention has been made in the light of the above aspect and is aimed to the provision of a simple, handy forked shell and membrane stripping means capable of simultaneously stripping the shell and membrane of the boiled eggs, which has a forked portion comprising three forks, one central fork and two side forks. The central fork has at its front end a head whose inner face is flat while outer face thereof may preferably be mountain-shaped or provided with a ridge. While, the two side forks are bridged at their front ends to constitute a guide face sliding on the outer surface of the egg-shell so as to guide the central fork which is to creep under the membrane of the boiled egg.

BRIEF DESCRIPTION OF THE DRAWINGS

This invention may be best understood by reference to the following description taken in connection with the accompanying drawings, in which.

DETAILED DESCRIPTION

Figure 1:
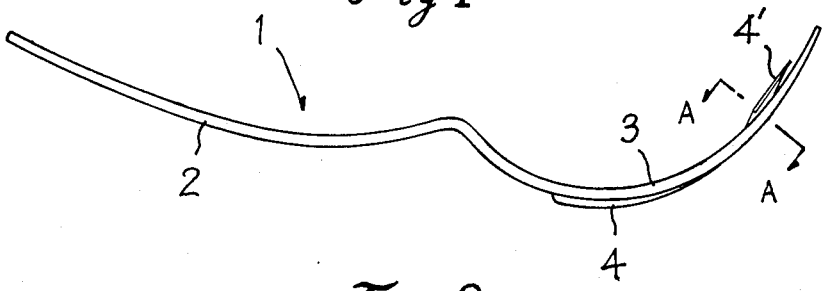
FIG. 1 is a front view of a forked shell and membrane stripper according to this invention.
Figure 2:
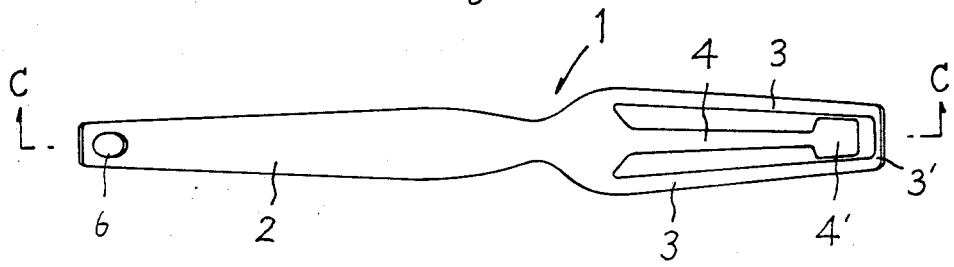
FIG. 2 is a plan view of the same.
Figure 3:
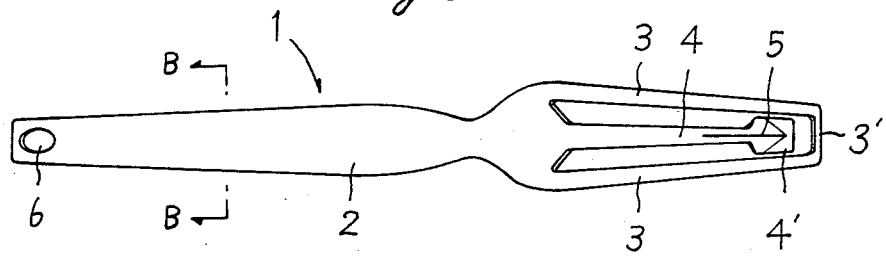
FIG. 3 is a bottom view of the same.
Figure 4:
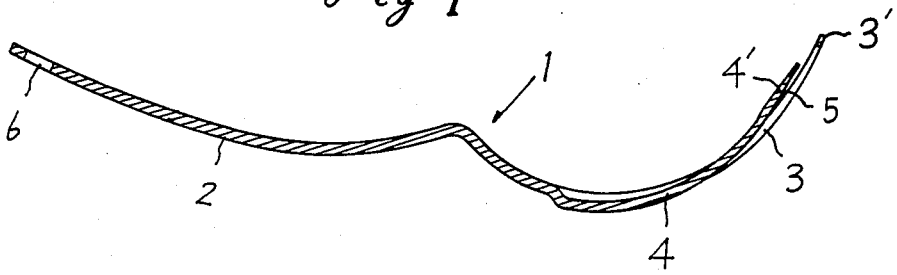
FIG. 4 is a sectional view taken along line C—C in FIG. 2.
Figure 6:
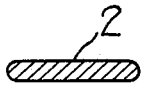
FIG. 6 is a cross-section taken along line B—B in FIG. 3.
Figure 5:
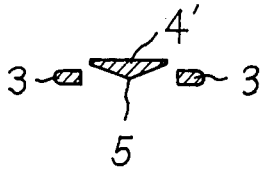
FIG. 5 is a cross-section taken along line A—A in FIG. 1.
Figure 7:
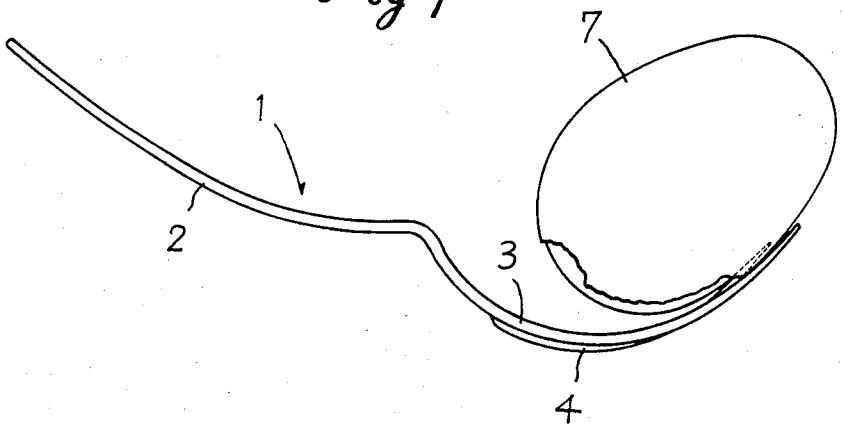
FIG. 7 is an explanatory view which shows how the egg-shell and membrane stripper is used for stripping the shell and membrane from the contents of the egg.
Figure 8:
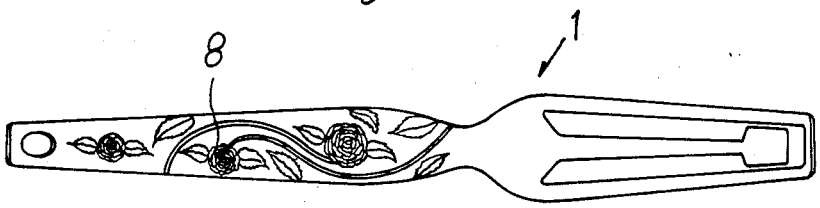
FIG. 8 is an example in which a ornamental design is manifested on the stem of the stripper.

Referring now to the drawings, a forked shell and membrane stripper, indicated as a whole by reference numeral 1, consists of a stem portion 2 and a three-forked portion which has one central fork 4 and two side forks 3 as shown in FIGS. 2 and 3. Both the central and side forks are curved as a whole with substantially the same curvature as that of the longitudinal direction of the egg-shell, although the central fork is more curved than the side forks as shown in FIGS. 1, 4 and 7. It is to be noted that, in this specification, the upper side in FIG. 1 is referred to as inner and the lower side as outer with respect to the forked portion. Both sides of the stem portion 2 and the side forks are rounded for safety purpose as shown in FIGS. 5 and 6. The central fork 4 extends from under the side forks 3, 3 and protrudes slightly from the side forks 3 passing through between them at its front portion, or head portion 4' as shown in FIGS. 1, 4 and 7 to constitute a nipping gap which may vary by virtue of the elasticities of the central fork and the side forks. The head portion 4' of the central fork 4 has a flat face on its inner side for creeping on the surface of the albumen as shown in FIG. 2, while the outer side which is to creep under the membrane of the egg may preferably be mountain-shaped or provided with a ridge 5 as shown in FIG. 3 so that the egg-shell and membrane may be easily by broken. The side forks 3, 3 are bridged at their front ends so as to constitute a guide face 3' which slides on the outer surface of the egg-shell for guiding the central fork 4 which is to creep under the membrane of the boiled egg 7. Although the shape of the head portion 4' of the central fork 4 is illustrated as being substantially square one, it is not critical feature of this invention and there may employed any suitable shapes such as round or hexagonal one unless it gives damage to the surface of the albumen. The stripper of this invention may be fabricated of a metallic, woody or hard-resinous material which possesses a proper elasticity.

When using the shell and membrane stripper of this invention, the shell and membrane of the boiled egg is firstly broken by the front end of the side forks, for example, and then the head portion 4' of the central fork 4 is inserted to creep under the membrane of the boiled egg 7 while leaving the side forks 3, 3 and their front ends, or the guide face 3' on the outer surface of the shell and then the stripper 1 is moved forthward along the outer surface of the egg, or alternatively, the egg is rotated toward the stripper 1 so that the nipping gap formed between the central fork 4 and the side forks 3, 3 may nip the shell and membrane and cut open them. By doing so, both the egg-shell and membrane are simultaneouly cut open and finally stripped off from the contents of the egg 7.

As described above, thanks to the advent of the stripper of this invention, there can now be stripped a large number of boiled eggs in a quite short time without giving any damage to the contents thereof.

Lastly, though not essential feature of this invention, other reference numerals, viz., 6 and 8 respectively designate a hole for hanging purpose and an ornamental design.

What is claimed is:

1. A forked shell and membrane stripper for boiled eggs capable of simultaneously stripping the shell and membrane of the boiled eggs consisting of a stem portion and a forked portion comprising a central fork having a free end formed with a head and two elongate side members straddling the central fork, the side members having front ends remote from the stem portion which are bridged by a cross-piece to constitute a guide face for guiding the central fork while sliding on the outer surface of the egg-shell so that the central fork may creep under the membrane of the boiled egg, said central fork and side members being curved longitudinally, the central fork extending from a junction with the stem portion at a level under the side members, passing through a plane containing the side members and protruding at its free end to a level above the side members, and the head of the central fork terminating short of the cross-piece, with a nipping gap formed between the head, the cross-piece and the side members for cutting open the shell and membrane simultaneously.

2. A forked shell and membrane stripper for boiled eggs according to claim 1, wherein the head has a flat top surface and a longitudinally ridged undersurface.

* * * * *